US011138952B2

(12) United States Patent
Lee et al.

(10) Patent No.: US 11,138,952 B2
(45) Date of Patent: Oct. 5, 2021

(54) DISPLAY DEVICE SUPPORTING VARIABLE FRAME MODE, AND METHOD OF OPERATING DISPLAY DEVICE

(71) Applicant: Samsung Display Co., Ltd., Yongin-si (KR)

(72) Inventors: Jong Jae Lee, Hwaseong-si (KR); Yoon Soo Kwon, Hwaseong-si (KR); Young Ho Oh, Asan-si (KR); Ju-Ah Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 139 days.

(21) Appl. No.: 16/662,478

(22) Filed: Oct. 24, 2019

(65) Prior Publication Data

US 2020/0135146 A1 Apr. 30, 2020

(30) Foreign Application Priority Data

Oct. 26, 2018 (KR) ..... 10-2018-0128866

(51) Int. Cl.
*G09G 5/10* (2006.01)

(52) U.S. Cl.
CPC ..... *G09G 5/10* (2013.01); *G09G 2310/0237* (2013.01); *G09G 2320/064* (2013.01)

(58) Field of Classification Search
CPC .... G09G 5/10; G09G 5/006; G09G 2320/064; G09G 2320/0247; G09G 2320/0233; G09G 2320/02; G09G 2340/0435; G09G 3/3406; G09G 3/3413; G09G 2310/0237
See application file for complete search history.

(56) References Cited

U.S. PATENT DOCUMENTS

2005/0083280 A1* 4/2005 Hiraki ..... G09G 3/2092 345/87
2009/0102854 A1* 4/2009 Lai ..... G09G 3/20 345/589
2012/0126720 A1* 5/2012 Kim ..... H04N 13/398 315/307
2017/0206850 A1* 7/2017 Kim ..... G09G 3/3696

FOREIGN PATENT DOCUMENTS

KR 10-1610920 B1 4/2016

* cited by examiner

*Primary Examiner* — Alexander Eisen
*Assistant Examiner* — Kebede T Teshome
(74) *Attorney, Agent, or Firm* — Lewis Roca Rothgerber Christie LLP

(57) ABSTRACT

A display device supports a variable frame mode where each frame includes a variable blank period. The display device includes a display panel including a plurality of pixels, a backlight unit configured to generate light, a panel driver configured to drive the display panel, a backlight controller configured to drive the backlight unit, and a blank counter configured to count a time of the variable blank period. The backlight controller controls the backlight unit to increase an intensity of the light generated by the backlight unit as the counted time of the variable blank period increases.

20 Claims, 14 Drawing Sheets

DISPLAY DEVICE SUPPORTING VARIABLE FRAME MODE, AND METHOD OF OPERATING DISPLAY DEVICE

CROSS-REFERENCE TO RELATED APPLICATION

This application claims priority to and the benefit of Korean Patent Application No. 10-2018-0128866, filed on Oct. 26, 2018, in the Korean Intellectual Property Office (KIPO), the content of which is incorporated herein in its entirety by reference.

BACKGROUND

1. Field

Exemplary embodiments of the present inventive concept relate to display devices, and more particularly to display devices supporting variable frame modes, and methods of operating the display devices.

2. Description of the Related Art

A display device may generally display (or refresh) an image with (or at) a constant frame rate (refresh frame rate) of about 60 Hz or more. However, a frame rate of rendering by a host processor (e.g., a graphic processing unit (GPU) or a graphic card), which provides frame data to the display device, may be different from the refresh frame rate of the display device. In particular, when the host processor provides the display device with frame data for a game image (gaming image) that requires complicated rendering, the frame rate mismatch may be intensified (e.g., aggravated), and a tearing phenomenon where a boundary line is caused by (e.g., is exhibited due to) the frame rate mismatch in an image of the display device may occur.

To reduce or prevent the tearing phenomenon, a variable frame mode (e.g., Free-Sync, G-Sync, etc.,) in which a host processor provides frame data to a display device with a variable frame rate by changing a time of a blank period in each frame has been developed. A display device supporting the variable frame mode may display (or refresh) an image in synchronization with the variable frame rate, thereby reducing or preventing the tearing phenomenon.

However, in the display device operating in the variable frame mode, the time (or a duration of time) of the blank period may be increased compared with a time of a blank period in a normal mode in which an image is displayed with a constant frame rate, and the increased blank period may cause a leakage current, etc., which may result in deterioration of luminance and a flicker (e.g., a flickering image) between a previous frame in which the luminance is reduced and a current frame in which an image is refreshed.

SUMMARY

An aspect according to some example embodiments is directed toward a display device capable of improving an image quality in a variable frame mode.

An aspect according to some example embodiments is directed toward a method of operating a display device capable of improving an image quality in a variable frame mode.

According to example embodiments, a display device supporting a variable frame mode where each frame includes a variable blank period is provided. The display device includes a display panel including a plurality of pixels, a backlight unit configured to generate light, a panel driver configured to drive the display panel, a backlight controller configured to drive the backlight unit, and a blank counter configured to count a time of the variable blank period. The backlight controller is configured to control the backlight unit to increase an intensity of the light generated by the backlight unit as the counted time of the variable blank period increases.

In example embodiments, the backlight controller may be configured to increase a duty ratio of a backlight driving signal provided to the backlight unit as the counted time of the variable blank period increases such that a transmittance of the display panel that is decreased as the counted time of the variable blank period increases is compensated.

In example embodiments, the backlight controller may be configured to increase a duty ratio of a backlight driving signal provided to the backlight unit stepwise each time the counted time of the variable blank period reaches one of a plurality of reference times.

In example embodiments, the backlight controller may include a control unit configured to generate a duty ratio control signal representing the duty ratio that is increased stepwise each time the counted time of the variable blank period reaches one of the plurality of reference times, a control voltage generator configured to generate a control voltage, and a backlight driver configured to generate the backlight driving signal having the duty ratio indicated by the duty ratio control signal based on the control voltage and the duty ratio control signal.

In example embodiments, the control unit may be configured to receive an adaptive synchronization signal representing a start or an end of the variable blank period, and may initialize the duty ratio indicated by the duty ratio control signal when the adaptive synchronization signal indicates the end of the variable blank period.

In example embodiments, the backlight controller may be configured to increase (e.g., gradually increase) a current level of a backlight driving signal provided to the backlight unit as the counted time of the variable blank period increases such that a transmittance of the display panel that is decreased as the counted time of the variable blank period increases is compensated.

In example embodiments, the backlight controller may be configured to increase a current level of a backlight driving signal provided to the backlight unit stepwise each time the counted time of the variable blank period reaches one of a plurality of reference times.

In example embodiments, the backlight controller may include a control unit configured to generate a control voltage control signal representing a voltage level that is increased stepwise each time the counted time of the variable blank period reaches one of the plurality of reference times, a control voltage generator configured to generate a control voltage having the voltage level indicated by the control voltage control signal, and a backlight driver configured to generate the backlight driving signal having the current level corresponding to the voltage level of the control voltage based on the control voltage.

In example embodiments, the control unit may be configured to receive an adaptive synchronization signal representing a start or an end of the variable blank period, and may initialize the voltage level indicated by the control voltage control signal when the adaptive synchronization signal indicates the end of the variable blank period.

In example embodiments, the backlight controller may be configured to increase (e.g., gradually increase) a duty ratio or a current level of a backlight driving signal provided to the backlight unit as the counted time of the variable blank period increases such that a transmittance of the display panel that is decreased as the counted time of the variable blank period increases is compensated.

In example embodiments, each time the counted time of the variable blank period reaches one of a plurality of reference times, the backlight controller may be configured to increase a duty ratio of a backlight driving signal provided to the backlight unit stepwise until the duty ratio of the backlight driving signal reaches a maximum duty ratio, and may increase a current level of the backlight driving signal stepwise after the duty ratio of the backlight driving signal reaches the maximum duty ratio.

In example embodiments, the backlight controller may include a control unit configured to generate a duty ratio control signal representing the duty ratio that is increased stepwise each time the counted time of the variable blank period reaches one of the plurality of reference times until the duty ratio of the backlight driving signal reaches the maximum duty ratio, and to generate a control voltage control signal representing a voltage level that is increased stepwise each time the counted time of the variable blank period reaches one of the plurality of reference times after the duty ratio of the backlight driving signal reaches the maximum duty ratio, a control voltage generator configured to generate a control voltage having the voltage level indicated by the control voltage control signal, and a backlight driver configured to generate the backlight driving signal having the current level corresponding to the voltage level of the control voltage and having the duty ratio indicated by the duty ratio control signal based on the control voltage and the duty ratio control signal.

In example embodiments, the control unit may be configured to receive an adaptive synchronization signal representing a start or an end of the variable blank period, and may initialize the duty ratio indicated by the duty ratio control signal and the voltage level indicated by the control voltage control signal when the adaptive synchronization signal indicates the end of the variable blank period.

According to example embodiments, a display device supporting a variable frame mode where each frame includes a variable blank period is provided. The display device includes a display panel including a plurality of pixels, a backlight unit configured to generate light, a shutter panel configured to transmit the light generated by the backlight unit in response to a shutter driving signal, a panel driver configured to drive the display panel, a backlight controller configured to drive the backlight unit, a shutter driver configured to drive the shutter panel by providing the shutter driving signal to the shutter panel, and a blank counter configured to count a time of the variable blank period to provide a counted time of the variable blank period. The shutter driver is configured to increase the shutter driving signal provided to the shutter panel as the counted time of the variable blank period increases.

In example embodiments, the shutter driver may be configured to increase (e.g., gradually increase) a voltage level of the shutter driving signal to increase (e.g., gradually increase) a transmittance of the shutter panel as the counted time of the variable blank period increases.

In example embodiments, the shutter driver may be configured to determine the voltage level of the shutter driving signal such that a product of a transmittance of the display panel and the transmittance of the shutter panel is maintained as a constant.

In example embodiments, the shutter driver may be configured to increase a voltage level of the shutter driving signal stepwise each time the counted time of the variable blank period reaches one of a plurality of reference times.

According to example embodiments, a method of operating a display device supporting a variable frame mode where each frame includes a variable blank period is provided. The method includes counting a time of a variable blank period to provide a counted time of the variable blank period; comparing the counted time of the variable blank period with a plurality of reference times; and increasing an intensity of the light generated by a backlight unit stepwise each time the counted time of the variable blank period reaches one of the plurality of reference times.

In example embodiments, the increasing the intensity of the light generated by the backlight unit stepwise may include increasing a duty ratio of a backlight driving signal provided to the backlight unit stepwise.

In example embodiments, the increasing the intensity of the light generated by the backlight unit stepwise may include increasing a current level of a backlight driving signal provided to the backlight unit stepwise.

As described above, the display device and the method of operating the display device according to example embodiments may count a time of a variable blank period, and may increase an intensity of light generated by a backlight unit as the counted time of the variable blank period increases. Accordingly, deterioration of luminance and occurrence of a flicker caused by an increase in time of the variable blank period in a variable frame mode may be reduced or prevented, and thus the image quality of the display device may be improved.

Further, the display device and the method of operating the display device according to example embodiments may count a time of a variable blank period, and may increase a shutter driving signal provided to a shutter panel as the counted time of the variable blank period increases. Accordingly, deterioration of luminance and occurrence of a flicker caused by an increase in time of the variable blank period in a variable frame mode may be reduced or prevented, and thus the image quality of the display device may be improved.

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, embodiments of the present inventive concept will be explained in more detail with reference to the accompanying drawings.

Figure 1:
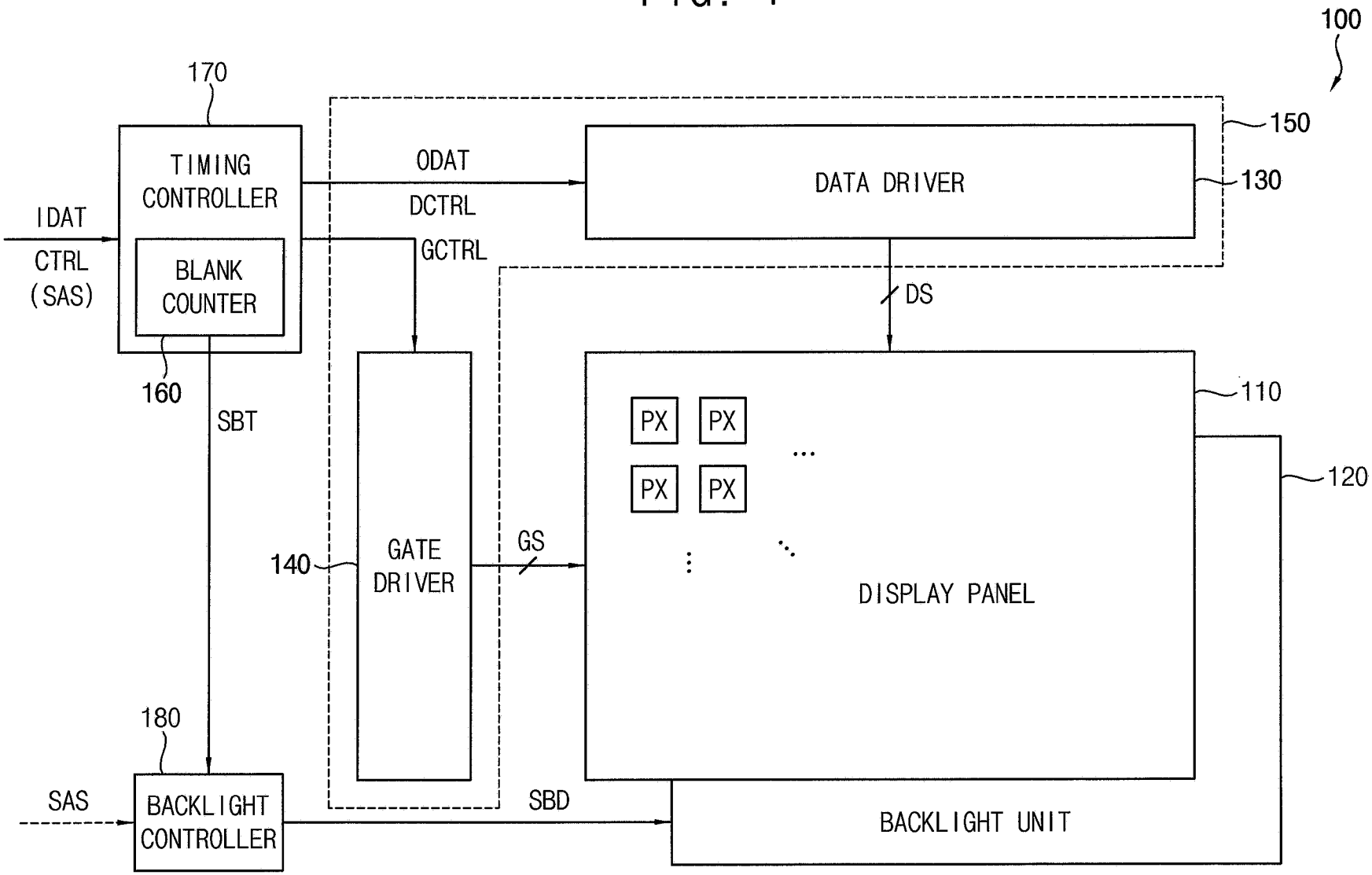
FIG. 1 is a block diagram illustrating a display device according to example embodiments.
Figure 2:
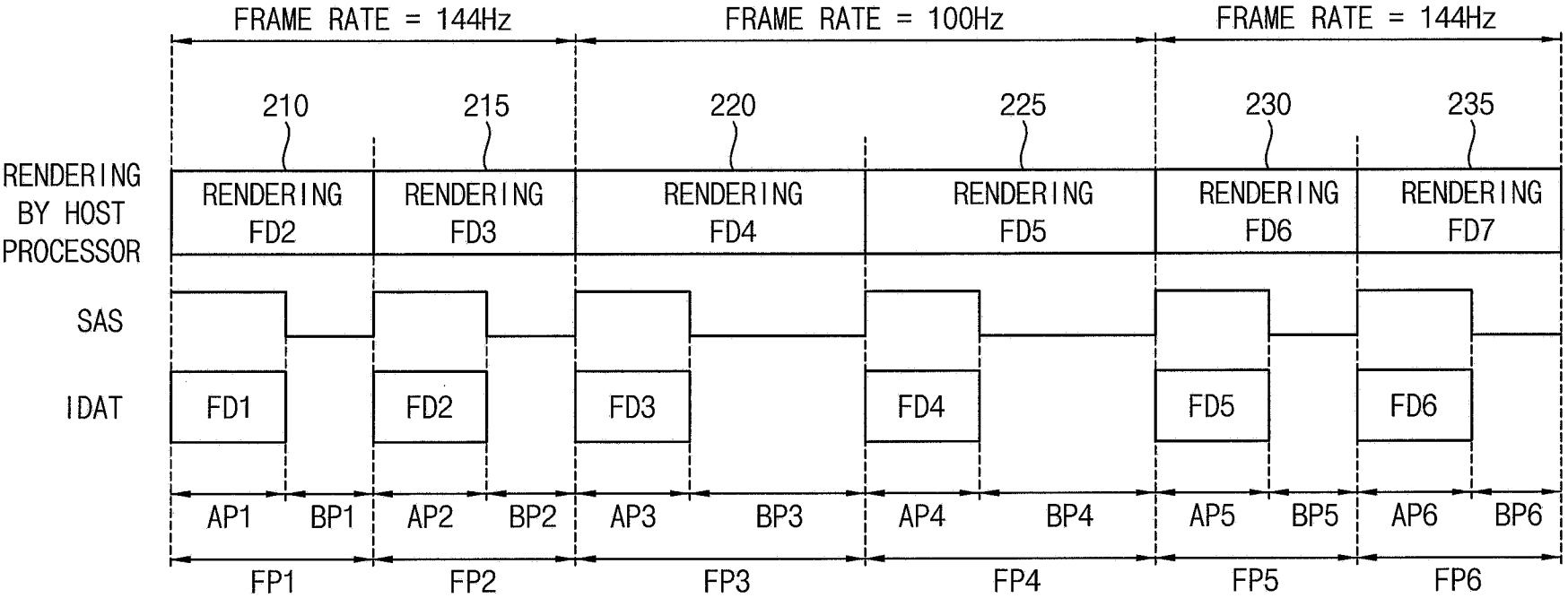
FIG. 2 is a diagram illustrating an example of input image data inputted to a display device in a variable frame mode.
Figure 3:
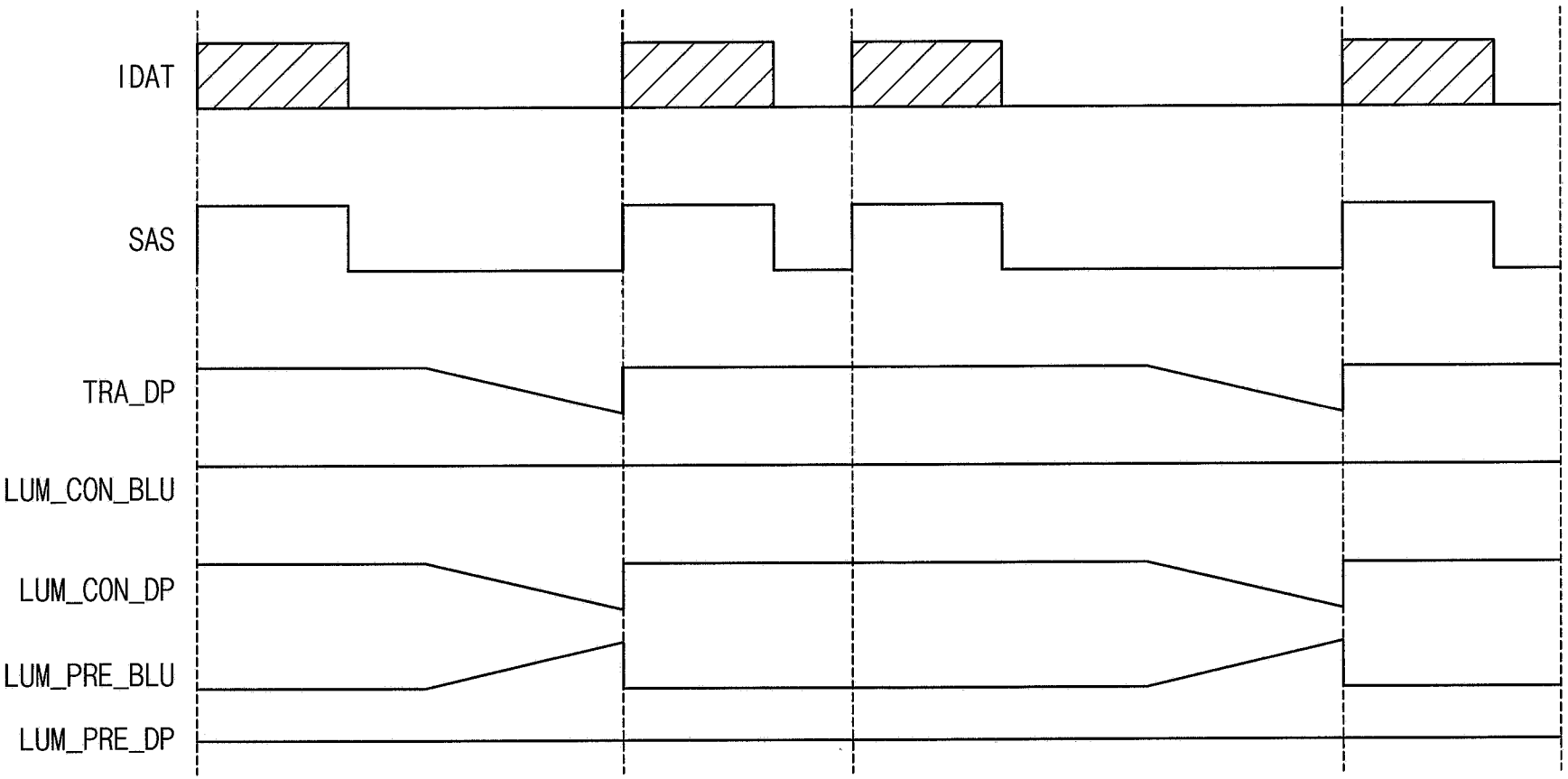
FIG. 3 is a timing diagram for describing examples of luminance of a related art display device and luminance of a display device according to example embodiments in a variable frame mode.

FIG. 1 is a block diagram illustrating a display device according to example embodiments, FIG. 2 is a diagram illustrating an example of input image data inputted to a display device in a variable frame mode, and FIG. 3 is a timing diagram for describing examples of luminance of a related art display device and luminance of a display device according to example embodiments in a variable frame mode.

Referring to FIG. 1, a display device 100 may include a display panel 110 including a plurality of pixels PX, a backlight unit (e.g., a backlight) 120 that generates light, a panel driver 150 that drives the display panel 110, a backlight controller 180 that drives the backlight unit 120, a blank counter 160 that counts a time of a variable blank period, and a timing controller 170 that controls an operation of the display device 100. In some example embodiments, the panel driver 150 may include a data driver 130 that provides data signals DS to the display panel 110, and a gate driver 140 that provides gate signals GS to the display panel 110.

The display panel 110 may include a plurality of data lines, a plurality of gate lines, and the plurality of pixels PX coupled to the plurality of data lines and the plurality of gate lines. The display panel 110 may display an image by transmitting the light generated by the backlight unit 120. In some example embodiments, each pixel PX may include a switching transistor and a liquid crystal capacitor coupled to the switching transistor, and the display panel 110 may be a liquid crystal display (LCD) panel. However, the display panel 110 may not be limited to the LCD panel, and may be any suitable display panel.

The backlight unit 120 may generate light in response to a backlight driving signal SBD generated by the backlight controller 180, and may provide the generated light to the display panel 110. In some example embodiments, the backlight unit 120 may be a direct-type light emitting diode (LED) (e.g., a direct LED) backlight or an edge-type LED (e.g., an edge LED) backlight. For example, the direct-type LED backlight may include LEDs arranged over an entire display region and a plurality of optical sheets arranged over the LEDs, and may be configured in such a way that light emitted from the LEDs is irradiated to the display panel 110 through the plurality of optical sheets. Further, for example, the edge-type LED backlight may include a light guide plate facing the display panel 110, LEDs disposed to face at least one edge of the light guide plate, and a plurality of optical sheets disposed on the light guide plate, and may be configured in such a way that light emitted from the LEDs is converted by the light guide plate into light of a surface light source and is irradiated to the display panel 110 through the plurality of optical sheets. In other example embodiments, the backlight unit 120 may include, but not be limited to, a fluorescent lamp, such as a cold cathode fluorescent lamp (CCFL), an external electrode fluorescent lamp (EEFL), etc.

The data driver 130 may generate the data signals DS based on image data ODAT and a data control signal DCTRL output from the timing controller 170, and may provide the data signals DS to the display panel 110. For example, the data control signal DCTRL may include, but not be limited to, an output data enable signal, a horizontal start signal and a load signal. In some example embodiments, the data driver 130 may be implemented with one or more data integrated circuits (ICs). Further, according to some example embodiments, the data driver 130 may be mounted directly on the display panel 110, or may be coupled to the display panel 110 in a form of a tape carrier package (TCP). In other example embodiments, the data driver 130 may be integrated in a peripheral portion of the display panel 110.

The gate driver 140 may generate the gate signals GS based on a gate control signal GCTRL from the timing controller 170, and may provide the gate signals GS to the display panel 110. In some example embodiments, the gate control signal GCTRL may include, but not be limited to, a gate start signal and a gate clock signal. In some example embodiments, the gate driver 140 may be implemented as an amorphous silicon gate (ASG) driver integrated in the peripheral portion of the display panel 110. In other example embodiments, the gate driver 140 may be implemented with one or more gate ICs. Further, according to some example embodiments, the gate driver 140 may be mounted directly on the display panel 110, or may be coupled to the display panel 110 in the form of the TCP.

The timing controller 170 may receive input image data IDAT and a control signal CTRL from an external host processor (e.g., a graphic processing unit (GPU) or a graphic card). In some example embodiments, the input image data IDAT may be RGB data including red image data, green image data and/or blue image data. In some example embodiments, the control signal CTRL may include an adaptive synchronization signal SAS representing a start or an end of a variable blank period (or an active period). For example, the adaptive synchronization signal SAS may have a falling edge at the start of the variable blank period (or at the end of the active period), and may have a rising edge at the end of the variable blank period (or at the start of the active period). However, the adaptive synchronization signal SAS may not be limited to the example described above. In some example embodiments, the control signal CTRL may further include, but not be limited to, a vertical synchronization signal, a horizontal synchronization signal, an input data enable signal, a master clock signal, etc. The timing controller 170 may generate the gate control signal GCTRL, the data control signal DCTRL and the output image data ODAT based on the control signal CTRL and the input image data IDAT. The timing controller 170 may control an operation of the data driver 130 by providing the data control signal DCTRL and the output image data ODAT to the data driver 130, and may control an operation of the gate driver 140 by providing the gate control signal GCTRL to the gate driver 140.

The timing controller 170 according to example embodiments may support a variable frame mode in which the host processor provides the input image data IDAT to the display device 100 with a variable frame rate by changing a time (or a duration of time) of the variable blank period in each frame, and the timing controller 170 provides the output image data ODAT to the data driver 130 in synchronization with the variable frame rate such that an image is displayed (or refreshed) with the variable frame rate. For example, the variable frame mode may include a Free-Sync mode, a G-Sync mode, etc.

For example, as illustrated in FIG. 2, a period or a frequency of each of renderings 210, 215, 220, 225, 230 and 235 by the host processor (e.g., the GPU or the graphic card) may not be constant (e.g., in a case where game image data are rendered), and the host processor may provide the input image data IDAT, or frame data FD1, FD2, FD3, FD4, FD5 and FD6 to the display device 100 respectively in synchronization with these irregular periods of renderings 210, 215, 220, 225, 230 and 235 in the variable frame mode. Thus, in the variable frame mode, each frame FP1, FP2, FP3, FP4, FP5 and FP6 may include a constant active period AP1, AP2, AP3, AP4, AP5 and AP6 having a constant time, and the host processor may provide the frame data FD1, FD2, FD3, FD4, FD5 and FD6 to the display device 100 with a variable frame rate by changing a time of a variable blank period BP1, BP2, BP3, BP4, BP5 and BP6 of the frame FP1, FP2, FP3, FP4, FP5 and FP6. Further, the host processor may provide the adaptive synchronization signal SAS having a high level (e.g., higher level) during the active period AP1, AP2, AP3, AP4, AP5 and AP6 and a low level (e.g., lower level) during the variable blank period BP1, BP2, BP3, BP4, BP5 and BP6.

In an example of FIG. 2, if renderings 210 and 215 for the second and third frame data FD2 and FD3 are performed with a frequency of about 144 Hz in the first and second frames FP1 and FP2, the host processor may provide the first and second frame data FD1 and FD2 to the display device 100 with a frame rate of about 144 Hz in the first and second frames FP1 and FP2. Further, the host processor may output the third frame data FD3 during an active period AP3 of a third frame FP3, may continue a variable blank period BP3 of the third frame FP3 until rendering 220 for the fourth frame data FD4 is completed, may output the fourth frame data FD4 during an active period AP4 of a fourth frame FP4, and may continue a variable blank period BP4 of the fourth frame FP4 until rendering 225 for the fifth frame data FD5 is completed. Thus, in the third and fourth frames FP3 and FP4, if the renderings 220 and 225 for the fourth and fifth frame data FD4 and FD5 are performed with a frequency of about 100 Hz, the host processor may provide the third and fourth frame data FD3 and FD4 to the display device 100 with a frame rate of about 100 Hz by increasing time (e.g., duration) of the variable blank periods BP3 and BP4 of the third and fourth frames FP3 and FP4. In the fifth and sixth frames FP5 and FP6, if renderings 230 and 235 for the sixth and seventh frame data FD6 and FD7 are performed again with a frequency of about 144 Hz, the host processor may provide the fifth and sixth frame data FD5 and FD6 to the display device 100 again with a frame rate of about 144 Hz.

As described above, in the variable frame mode, each frame FP1, FP2, FP3, FP4, FP5 and FP6 may include a constant active period AP1, AP2, AP3, AP4, AP5 and AP6 having a constant time regardless of a variable frame rate, and a variable blank period BP1, BP2, BP3, BP4, BP5 and BP6 having a variable time corresponding to the variable frame rate. For example, in the variable frame mode, the time of the variable blank period BP1, BP2, BP3, BP4, BP5 and BP6 may increase as the frame rate decreases. In the variable frame mode, the timing controller 170 may receive the input image data IDAT with the variable frame rate, and may output the output image data ODAT to the data driver 130 with the variable frame rate. Accordingly, the display device 100 supporting the variable frame mode may display (or refresh) an image in synchronization with the variable frame rate, thereby reducing or preventing a tearing phenomenon caused by a frame rate mismatch.

In the variable frame mode, because a time of the variable blank period may be changed in each frame, the time of the variable blank period may be increased compared with a time of a blank period in a normal mode where an image is displayed with a constant frame rate, and the increased variable blank period may cause a leakage current, etc., which may result in deterioration of luminance and deterioration of an image quality. Further, in the variable frame mode, a flicker between a previous frame in which the luminance is reduced and a current frame in which an image is refreshed may occur. In the display device 100 according to example embodiments, to reduce or prevent the image quality deterioration and the occurrence of the flicker caused by the leakage current in the variable blank period, the blank counter 160 may count the time of the variable blank period, and may provide a blank time signal SBT representing the counted time of the variable blank period to the backlight controller 180. In some example embodiments, the blank counter 160 may be included in the timing controller 170 as illustrated in FIG. 1, but a location of the blank counter 160 may not be limited thereto. For example, the blank counter 160 may be implemented within the backlight controller 180. The backlight controller 180 may control the backlight unit 120 to increase an intensity (or luminance) of the light generated by the backlight unit 120 as the counted time of the variable blank period increases.

For example, as illustrated in FIG. 3, in the variable frame mode, a transmittance TRA_DP of the display panel 110 may be decreased due to the leakage current, etc., as the counted time of the variable blank period increases. A backlight unit of a related art display device may have constant luminance LUM_CON_BLU even when the time of the variable blank period increases, and thus luminance LUM_CON_DP of the related art display device may be gradually decreased as the time of the variable blank period increases. However, in the display device 100 according to example embodiments, the backlight controller 180 may control the backlight unit 120 to have luminance LUM_PRE_BLU that is gradually increased as the time of the variable blank period increases. For example, the backlight controller 180 may control the backlight unit 120 such that a product of the transmittance TRA_DP of the display panel 110 and the luminance LUM_PRE_BLU of the backlight unit 120 is maintained as constant. Accordingly, although the transmittance TRA_DP of the display panel 110 is decreased as the time of the variable blank period increases, the display device 100 according to example embodiments may display an image with substantially constant luminance LUM_PRE_DP.

As described above, in the display device 100 according to example embodiments, the blank counter 160 may count the time of the variable blank period, and the backlight controller 180 may control the backlight unit 120 to increase the intensity of the light generated by the backlight unit 120 as the counted time of the variable blank period increases. Accordingly, the deterioration of the luminance and the occurrence of the flicker caused by the increase in time of the variable blank period in the variable frame mode may be reduced or prevented, and thus the image quality of the display device 100 may be improved.

Figure 4:
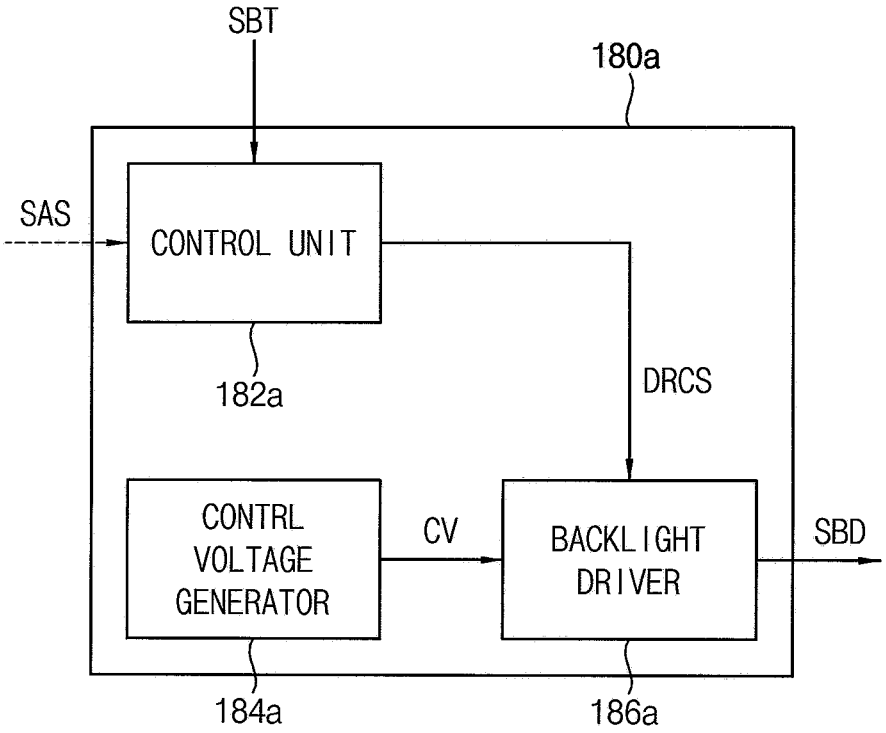
FIG. 4 is a block diagram illustrating a backlight controller included in a display device according to example embodiments.
Figure 5:
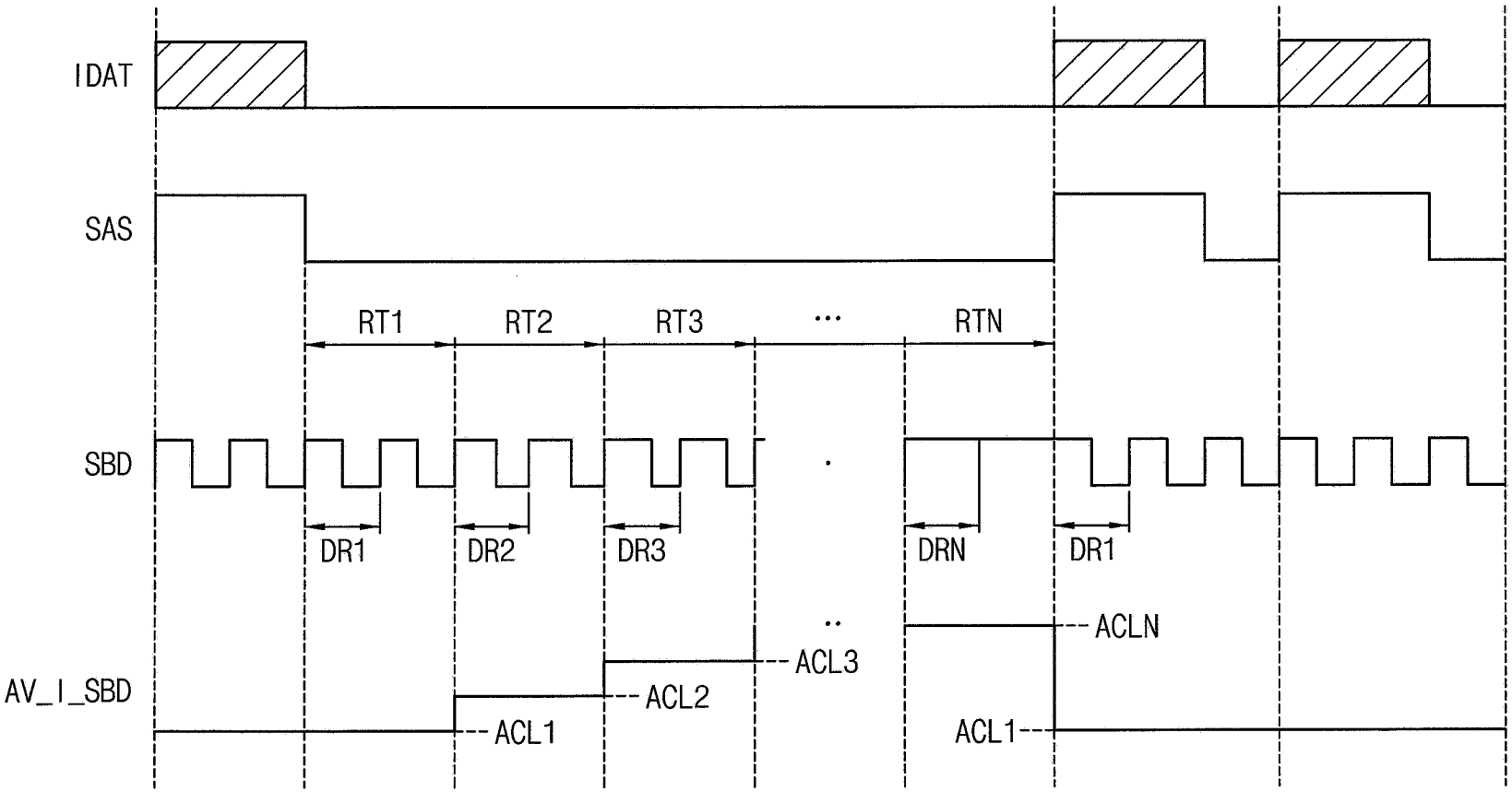
FIG. 5 is a timing diagram for describing an example of an operation of a backlight controller of FIG. 4.

FIG. 4 is a block diagram illustrating a backlight controller included in a display device according to example embodiments, and FIG. 5 is a timing diagram for describing an example of an operation of a backlight controller of FIG. 4.

Referring to FIG. 1 and FIG. 4, a backlight controller 180*a* included in a display device 100 according to example embodiments may gradually increase a duty ratio of a backlight driving signal SBD provided to a backlight unit 120 as a counted time of a variable blank period increases such that a transmittance of a display panel 110 that is decreased as the counted time of the variable blank period increases is compensated in a variable frame mode. For example, the backlight controller 180*a* may increase the duty ratio of the backlight driving signal SBD step-by-step (e.g., in a stepwise fashion) each time the counted time of the variable blank period reaches one of a plurality of reference times. To perform this operation, the backlight controller 180*a* may include a control unit 182*a*, a control voltage generator 184*a* and a backlight driver 186*a*.

The control unit 182*a* may receive a blank time signal SBT representing the counted time of the variable blank period, and may generate a duty ratio control signal DRCS representing the duty ratio that is increased step-by-step each time the counted time of the variable blank period reaches one of the plurality of reference times. In some example embodiments, the control unit 182*a* may further receive an adaptive synchronization signal SAS representing a start or an end of the variable blank period. According to example embodiments, the control unit 182*a* may receive the adaptive synchronization signal SAS directly from a host processor, or may receive the adaptive synchronization signal SAS through a timing controller 170 from the host processor. The control unit 182*a* may initialize (e.g., reset) the duty ratio indicated by the duty ratio control signal DRCS to an initial duty ratio when the adaptive synchronization signal SAS indicates the end of the variable blank period. The control voltage generator 184*a* may generate a control voltage CV. For example, the control voltage generator 184*a* may be implemented as a converter converting an input voltage into the control voltage CV. The backlight driver 186*a* may generate the backlight driving signal SBD having the duty ratio indicated by the duty ratio control signal DRCS based on the control voltage CV and the duty ratio control signal DRCS.

For example, as illustrated in FIG. 5, the control unit 182*a* may generate the duty ratio control signal DRCS indicating a second duty ratio DR2 greater than a first duty ratio DR1 (e.g. the initial duty ratio) when the counted time of the variable blank period reaches a first reference time RT1, and the backlight driver 186*a* may increase the duty ratio of the backlight driving signal SBD from the first duty ratio DR1 to the second duty ratio DR2 in response to the duty ratio control signal DRCS indicating the second duty ratio DR2. Accordingly, after the first reference time RT1, an average current AV_I_SBD of the backlight driving signal SBD may be increased from a first average current level ACL1 to a second average current level ACL2, and an intensity of light generated by the backlight unit 120 or luminance of the backlight unit 120 may be increased. Similarly, each time the counted time of the variable blank period reaches each of second through (N−1)-th reference times RT2, RT3, . . . , RTN−1, where N is an integer greater than 1, the control unit 182*a* may increase the duty ratio indicated by the duty ratio control signal DRCS step-by-step to third through (N)-th duty ratios DR3, DRN. At (N)-th reference time RTN, the variable blank period for the corresponding rendering may be over. The backlight driver 186*a* may increase the duty ratio of the backlight driving signal SBD step-by-step to the third through (N)-th duty ratios DR3, DRN in response to the duty ratio control signal DRCS indicating the step-by-step increased third through (N)-th duty ratios DR3, . . . , DRN. Accordingly, the average current AV_I_SBD of the backlight driving signal SBD may be increased step-by-step to third through (N)-th average current levels ACL3, . . . , ACLN, and the intensity of the light generated by the backlight unit 120 or the luminance of the backlight unit 120 may be step-by-step increased. Further, the control unit 182*a* may initialize (e.g., reset) the duty ratio indicated by the duty ratio control signal DRCS to the first duty ratio DR1 in response to the adaptive synchronization signal SAS indicating the end of the variable blank period (or a start of an active period), and the backlight driver 186*a* may initialize (e.g., reset) the duty ratio of the backlight driving signal SBD to the first duty ratio DR1 in response to the duty ratio control signal DRCS indicating the first duty ratio DR1. Accordingly, when the variable blank period ends (or when the active period starts), the average current AV_I_SBD of the backlight driving signal SBD may be initialized (e.g., reset to the initial value) to the first average current level ACL1, and the intensity of the light generated by the backlight unit 120 or the luminance of the backlight unit 120 may be initialized (e.g., reset to the initial value).

As described above, in the display device 100 including the backlight controller 180*a* according to example embodiments, as the time of the variable blank period increases, the intensity of the light generated by the backlight unit 120 may be increased by increasing the duty ratio of the backlight driving signal SBD. Accordingly, deterioration of luminance and occurrence of a flicker caused by an increase in time of the variable blank period in the variable frame mode may be reduced or prevented, and thus an image quality of the display device 100 may be improved.

Figure 6:
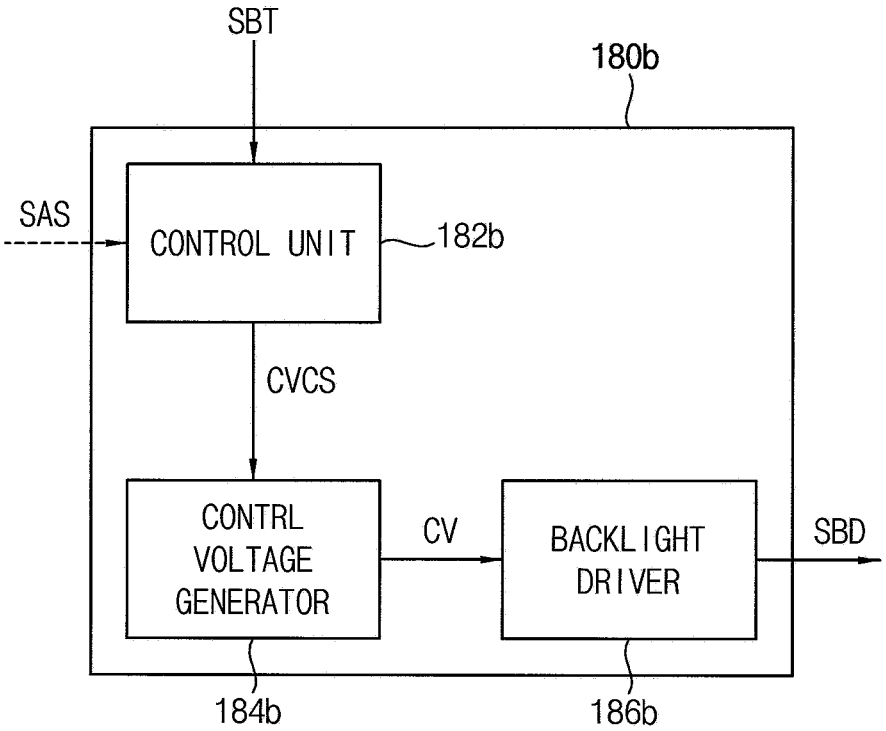
FIG. 6 is a block diagram illustrating a backlight controller included in a display device according to example embodiments.
Figure 7:
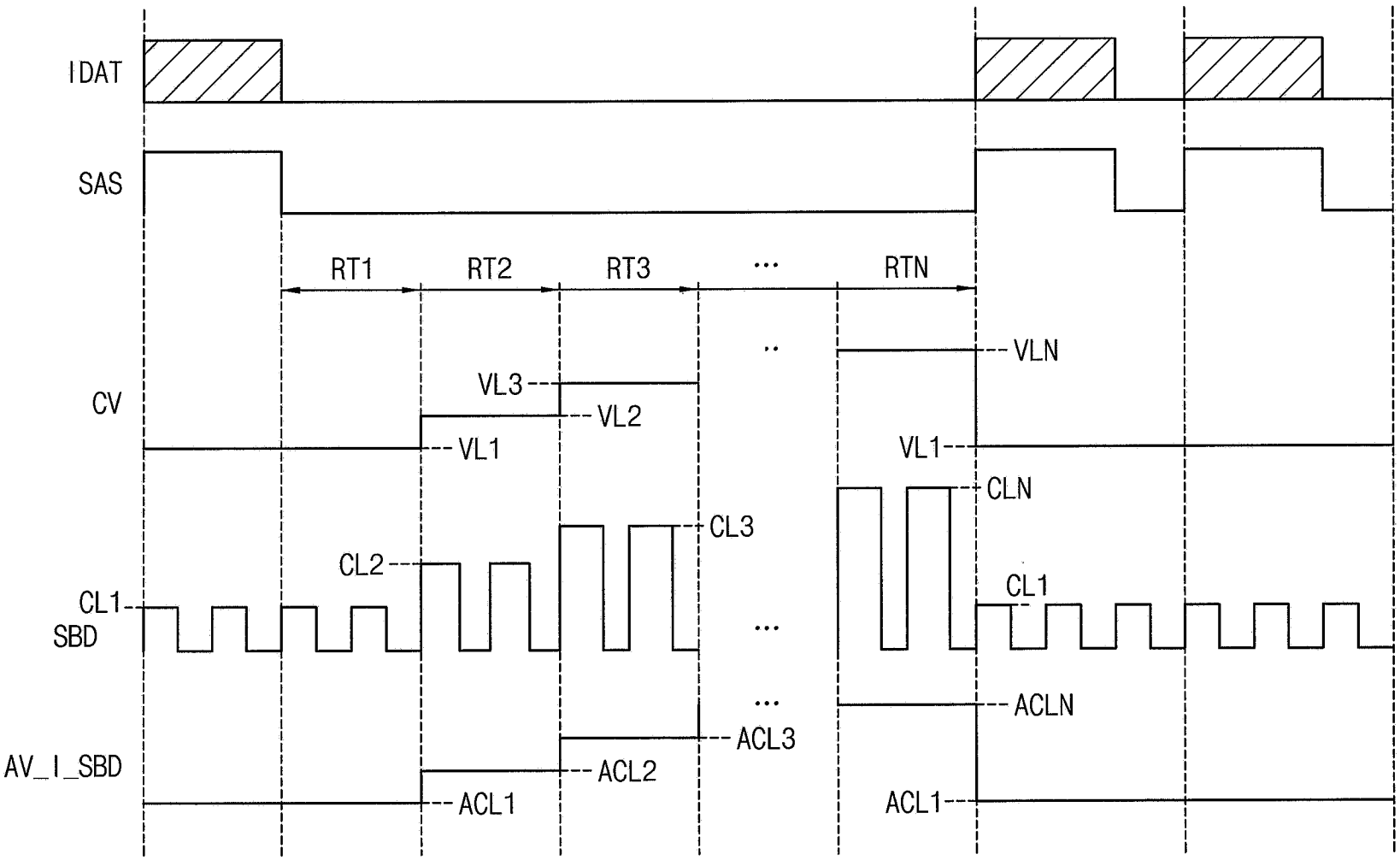
FIG. 7 is a timing diagram for describing an example of an operation of a backlight controller of FIG. 6.

FIG. 6 is a block diagram illustrating a backlight controller included in a display device according to example embodiments, and FIG. 7 is a timing diagram for describing an example of an operation of a backlight controller of FIG. 6.

Referring to FIG. 1 and FIG. 6, a backlight controller 180*b* included in a display device 100 according to example embodiments may gradually increase a current level of a backlight driving signal SBD (e.g., a current level in a high period of the backlight driving signal SBD having a pulse form, or a current level of a DC-type (e.g., DC) backlight driving signal SBD) provided to a backlight unit 120 as a counted time of a variable blank period increases such that a transmittance of a display panel 110 that is decreased as the counted time of the variable blank period increases is compensated in a variable frame mode. For example, the backlight controller 180*b* may increase the current level of the backlight driving signal SBD step-by-step (e.g., in a stepwise fashion) each time the counted time of the variable blank period reaches one of a plurality of reference times. To perform this operation, the backlight controller 180*b* may include a control unit 182*b*, a control voltage generator 184*b* and a backlight driver 186*b*.

The control unit 182*b* may receive a blank time signal SBT representing the counted time of the variable blank period, and may generate a control voltage control signal CVCS representing a voltage level that is increased step-by-step each time the counted time of the variable blank period reaches one of the plurality of reference times. In some example embodiments, the control unit 182*b* may further receive an adaptive synchronization signal SAS representing a start or an end of the variable blank period, and may initialize (e.g., reset) the voltage level indicated by the control voltage control signal CVCS to an initial voltage level when the adaptive synchronization signal SAS indicates the end of the variable blank period. The control voltage generator 184*b* may generate a control voltage CV having the voltage level indicated by the control voltage control signal CVCS. The backlight driver 186*b* may generate the backlight driving signal SBD having the current level corresponding to the voltage level of the control voltage CV based on the control voltage CV.

For example, as illustrated in FIG. 7, the control unit 182*b* may generate the control voltage control signal CVCS indicating a second voltage level VL2 greater than a first voltage level VL1 (e.g. the initial voltage level) when the counted time of the variable blank period reaches a first reference time RT1, the control voltage generator 184*b* may generate the control voltage CV having the second voltage level VL2 in response to the control voltage control signal CVCS indicating the second voltage level VL2, and the backlight driver 186*b* may increase the current level of the backlight driving signal SBD from a first current level CL1 to a second current level CL2 based on the control voltage CV having the second voltage level VL2. Accordingly, after the first reference time RT1, an average current AV_I_SBD of the backlight driving signal SBD may be increased from a first average current level ACL1 to a second average current level ACL2, and an intensity of light generated by the backlight unit 120 or luminance of the backlight unit 120 may be increased. Similarly, each time the counted time of the variable blank period reaches each of second through (N−1)-th reference times RT2, RT3, . . . , RTN−1, where N is an integer greater than 1, the control unit 182*b* may increase the voltage level indicated by the control voltage control signal CVCS step-by-step to third through (N)-th voltage levels VL3, . . . , VLN, the control voltage generator 184*b* may increase the control voltage CV step-by-step to the third through (N)-th voltage levels VL3, . . . , VLN, and the backlight driver 186*b* may increase the current level of the backlight driving signal SBD step-by-step to third through (N)-th current levels CL3, . . . , CLN based on the control voltage CV having the step-by-step increased third through (N)-th voltage levels VL3, . . . , VLN. Accordingly, the average current AV_I_SBD of the backlight driving signal SBD may be increased step-by-step to third through (N)-th average current levels ACL3, . . . , ACLN, and the intensity of the light generated by the backlight unit 120 or the luminance of the backlight unit 120 may be step-by-step increased. Further, the control unit 182*b* may initialize (e.g., reset) the voltage level indicated by the control voltage control signal CVCS to the first voltage level VL1 in response to the adaptive synchronization signal SAS indicating the end of the variable blank period (or a start of an active period), the control voltage generator 184*b* may initialize (e.g., reset) the control voltage CV to the first voltage level VL1, and the backlight driver 186*b* may initialize (e.g., reset) the current level of the backlight driving signal SBD to the first current level CL1 based on the control voltage CV having the first voltage level VL1. Accordingly, when the variable blank period ends (or when the active period starts), the average current AV_I_SBD of the backlight driving signal SBD may be initialized (e.g., reset) to the first average current level ACL1, and the intensity of the light generated by the backlight unit 120 or the luminance of the backlight unit 120 may be initialized (e.g., reset the intensity to an initial value).

As described above, in the display device 100 including the backlight controller 180*b* according to example embodiments, as the time of the variable blank period increases, the intensity of the light generated by the backlight unit 120 may be increased by increasing the current level of the backlight driving signal SBD. Accordingly, deterioration of luminance and occurrence of a flicker caused by an increase in time of the variable blank period in the variable frame mode may be reduced or prevented, and thus an image quality of the display device 100 may be improved.

Figure 8:
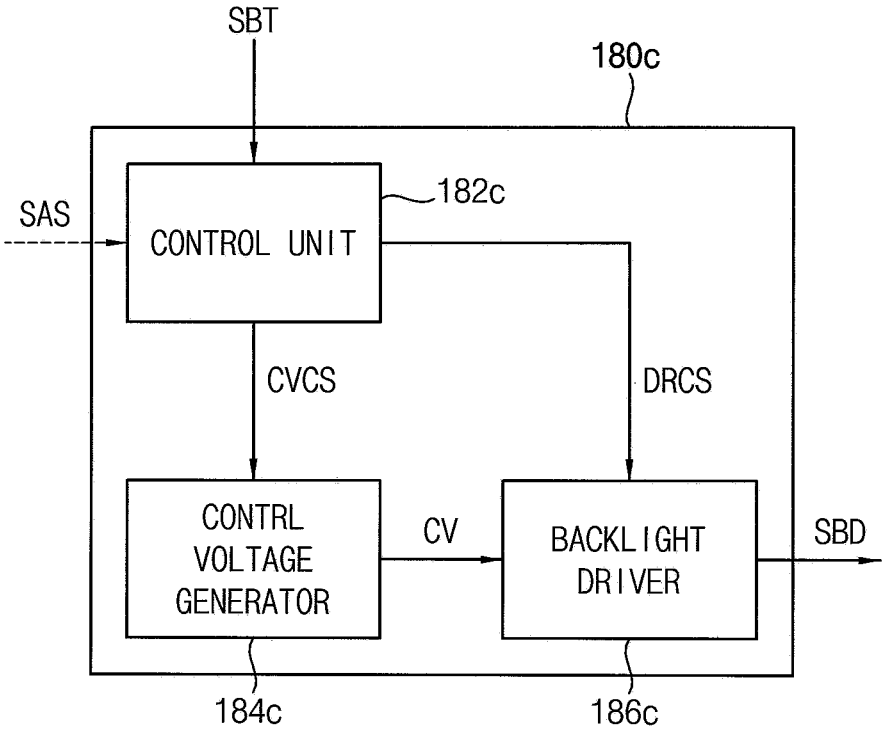
FIG. 8 is a block diagram illustrating a backlight controller included in a display device according to example embodiments.
Figure 9:
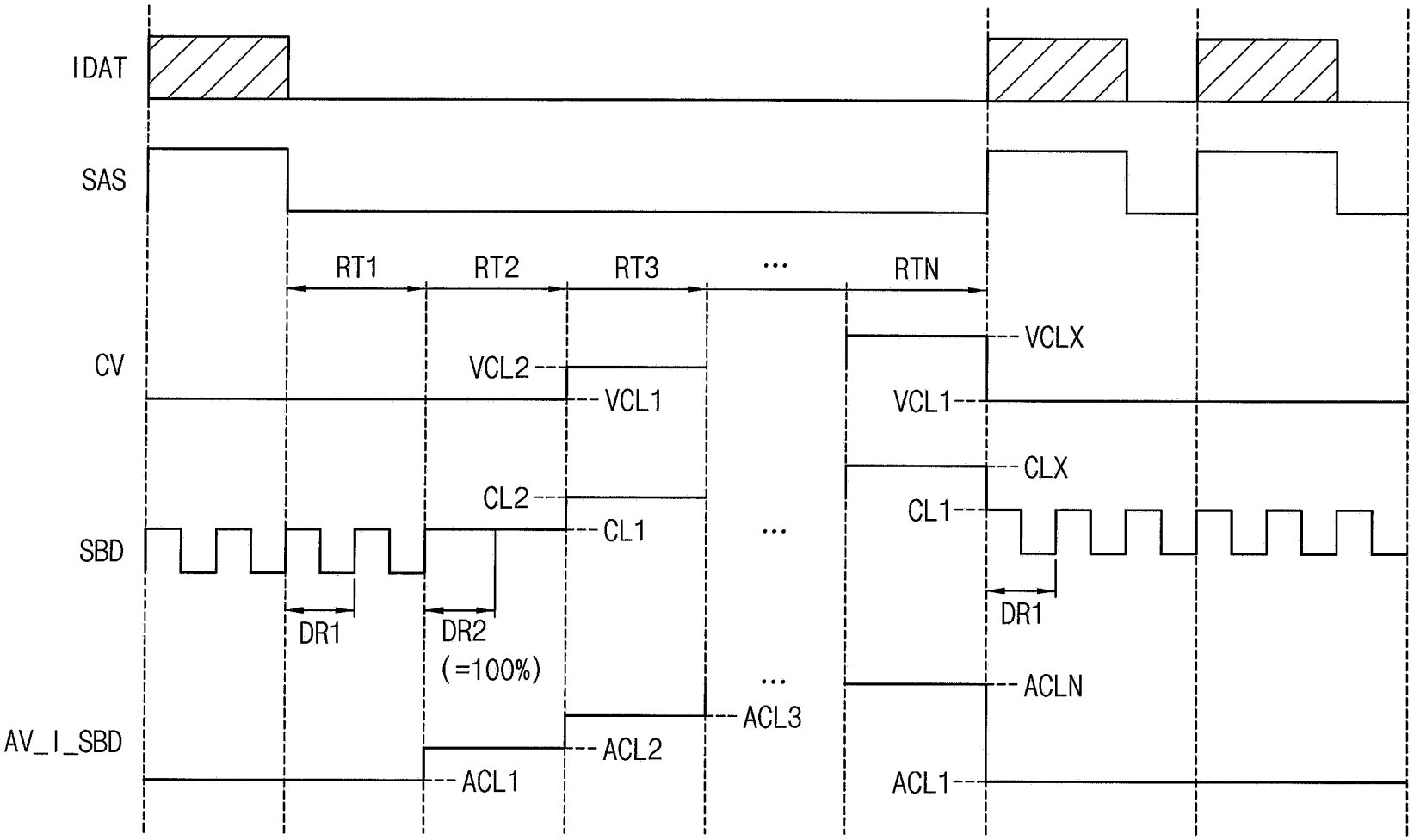
FIG. 9 is a timing diagram for describing an example of an operation of a backlight controller of FIG. 8.

FIG. 8 is a block diagram illustrating a backlight controller included in a display device according to example embodiments, and FIG. 9 is a timing diagram for describing an example of an operation of a backlight controller of FIG. 8.

Referring to FIG. 1 and FIG. 8, a backlight controller 180*c* included in a display device 100 according to example embodiments may gradually increase at least one of a duty ratio and a current level of a backlight driving signal SBD provided to a backlight unit 120 as a counted time of a variable blank period increases such that a transmittance of a display panel 110 that is decreased as the counted time of the variable blank period increases is compensated in a variable frame mode. For example, each time the counted time of the variable blank period reaches one of a plurality of reference times, the backlight controller 180*c* may increase the duty ratio of the backlight driving signal SBD step-by-step (e.g., in a stepwise fashion) until the duty ratio of the backlight driving signal SBD reaches a maximum duty ratio (e.g., about 100%), and may increase the current level of the backlight driving signal SBD step-by-step (e.g., in a stepwise fashion) after the duty ratio of the backlight driving signal SBD reaches the maximum duty ratio (e.g., about 100%). To perform this operation, the backlight controller 180*c* may include a control unit 182*c*, a control voltage generator 184*c* and a backlight driver 186*c*.

The control unit 182*c* may receive a blank time signal SBT representing the counted time of the variable blank period, may generate a duty ratio control signal DRCS representing the duty ratio that is increased step-by-step each time the counted time of the variable blank period reaches one of the plurality of reference times until the duty ratio of the backlight driving signal SBD reaches the maximum duty ratio (e.g., about 100%), and may generate a control voltage control signal CVCS representing a voltage level that is increased step-by-step each time the counted time of the variable blank period reaches one of the plurality of reference times after the duty ratio of the backlight driving signal SBD reaches the maximum duty ratio (e.g., about 100%). In some example embodiments, the control unit 182*c* may further receive an adaptive synchronization signal SAS representing a start or an end of the variable blank period. When the adaptive synchronization signal SAS indicates the end of the variable blank period, the control unit 182*c* may initialize (e.g., reset) the duty ratio indicated by the duty ratio control signal DRCS to an initial duty ratio, and may initialize (e.g., reset) the voltage level indicated by the control voltage control signal CVCS to an initial voltage level. The control voltage generator 184*c* may generate a control voltage CV having the voltage level indicated by the control voltage control signal CVCS. The backlight driver 186*c* may generate the backlight driving signal SBD having a current level corresponding to the voltage level of the control voltage CV and having the duty ratio indicated by the duty ratio control signal DRCS based on the control voltage CV and the duty ratio control signal DRCS.

For example, as illustrated in FIG. 9, each time the counted time of the variable blank period reaches first through (N−1)-th reference times RT1, RT2, RT3, . . . , RTN−1, the backlight controller 180*c* may increase the duty ratio of the backlight driving signal SBD step-by-step (e.g., to a second duty ratio DR2) until the duty ratio of the backlight driving signal SBD reaches the maximum duty ratio (e.g., about 100%), and may increase the current level of the backlight driving signal SBD step-by-step to first through X-th current levels CL1, CL2, . . . , CLX by increasing the voltage level indicated by the control voltage control signal CVCS step-by-step to first through X-th voltage levels VCL1, VCL2, . . . , VCLX after the duty ratio of the backlight driving signal SBD reaches the maximum duty ratio (e.g., about 100%). Accordingly, an average current AV_I_SBD of the backlight driving signal SBD may be increased from a first average current level ACL1 step-by-step to second through N-th average current levels ACL2, ACL3, . . . , ACLN, and an intensity of light generated by the backlight unit 120 or luminance of the backlight unit 120 may be step-by-step increased.

As described above, in the display device 100 including the backlight controller 180*c* according to example embodiments, as the time of the variable blank period increases, the intensity of the light generated by the backlight unit 120 may be increased by increasing the duty ratio and/or the current level of the backlight driving signal SBD. Accordingly, deterioration of luminance and occurrence of a flicker caused by an increase in time of the variable blank period in the variable frame mode may be reduced or prevented, and thus an image quality of the display device 100 may be improved.

Figure 10:
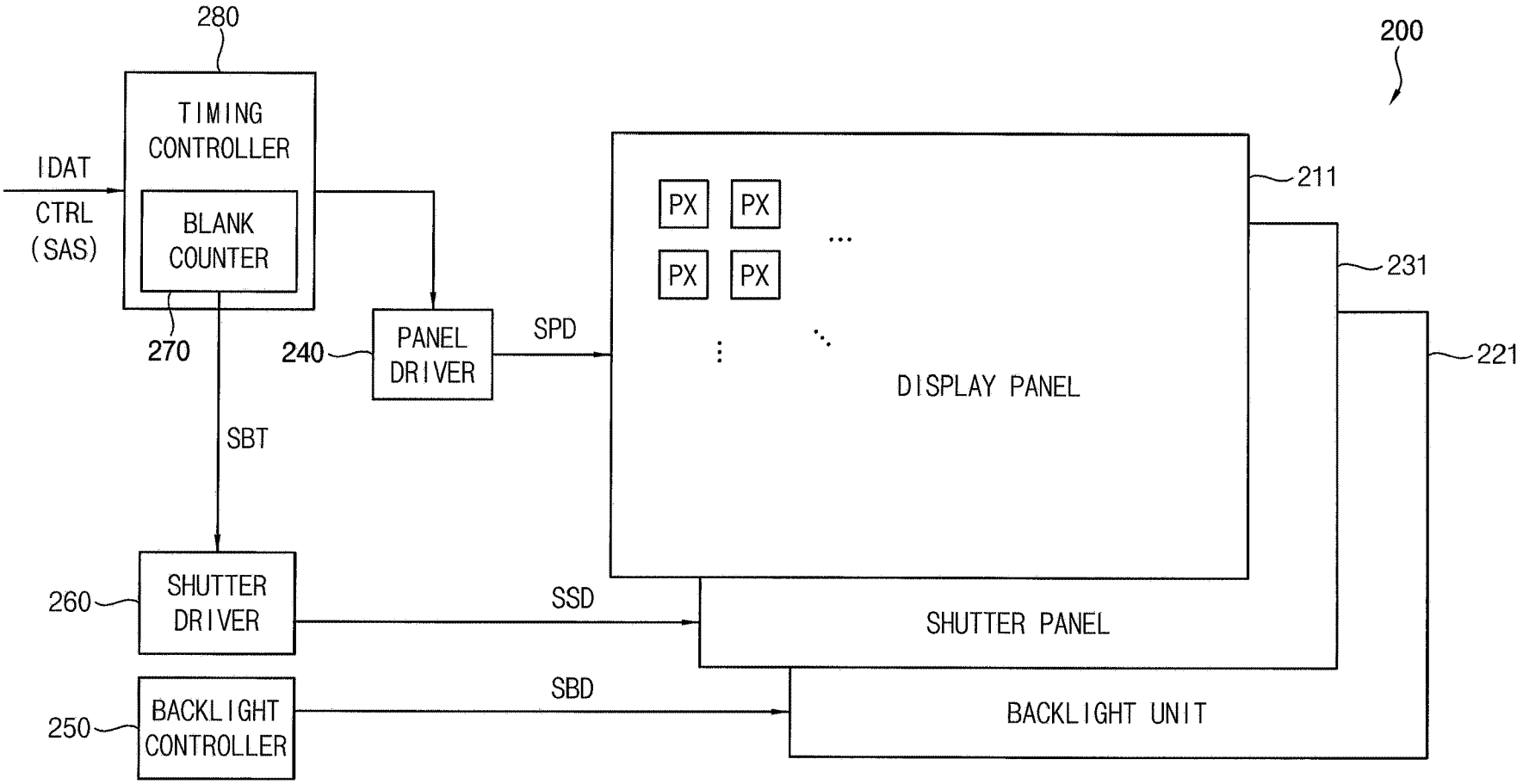
FIG. 10 is a block diagram illustrating a display device according to example embodiments.
Figure 11:
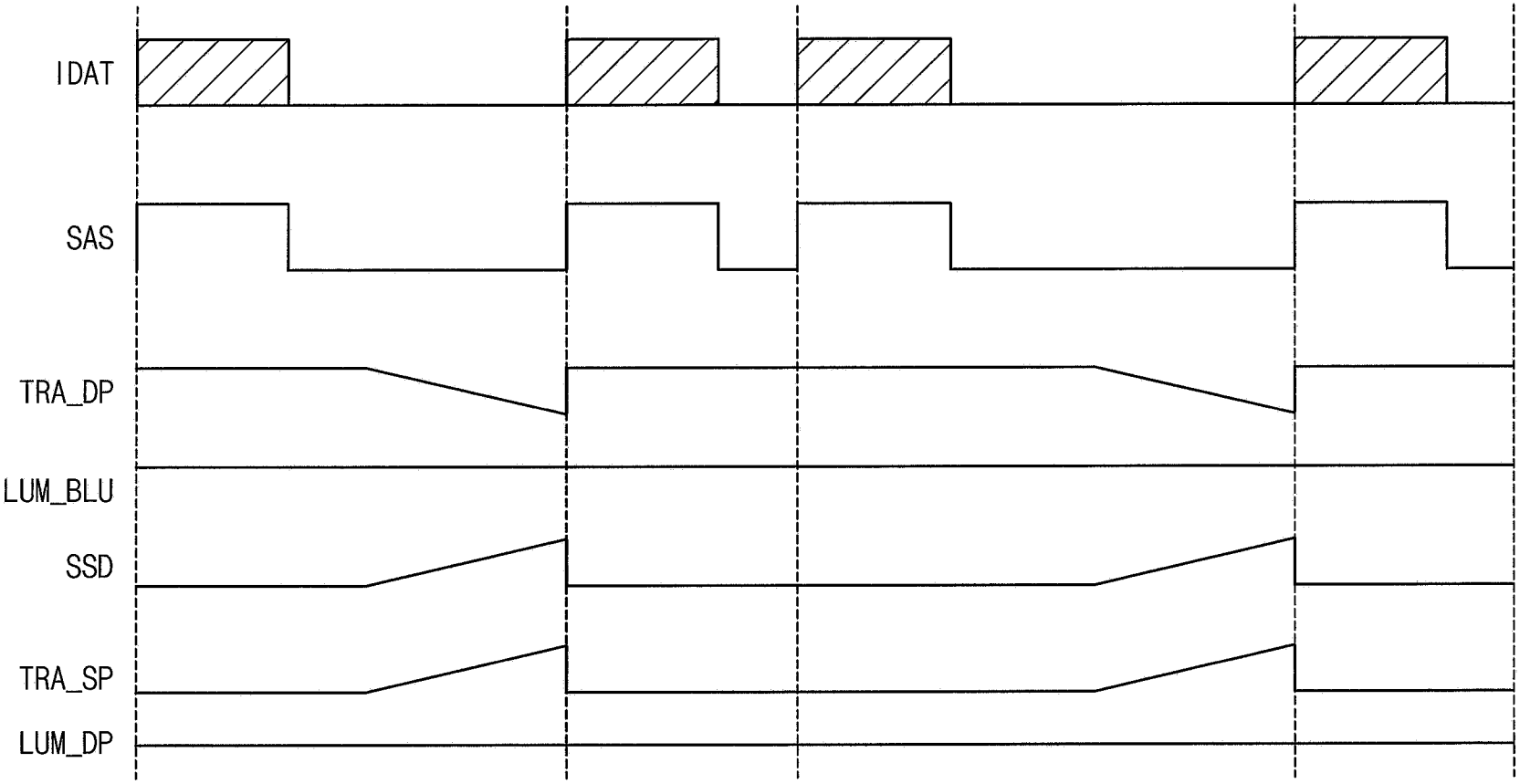
FIG. 11 is a timing diagram for describing an example of a display device of FIG. 10 in a variable frame mode.
Figure 12:
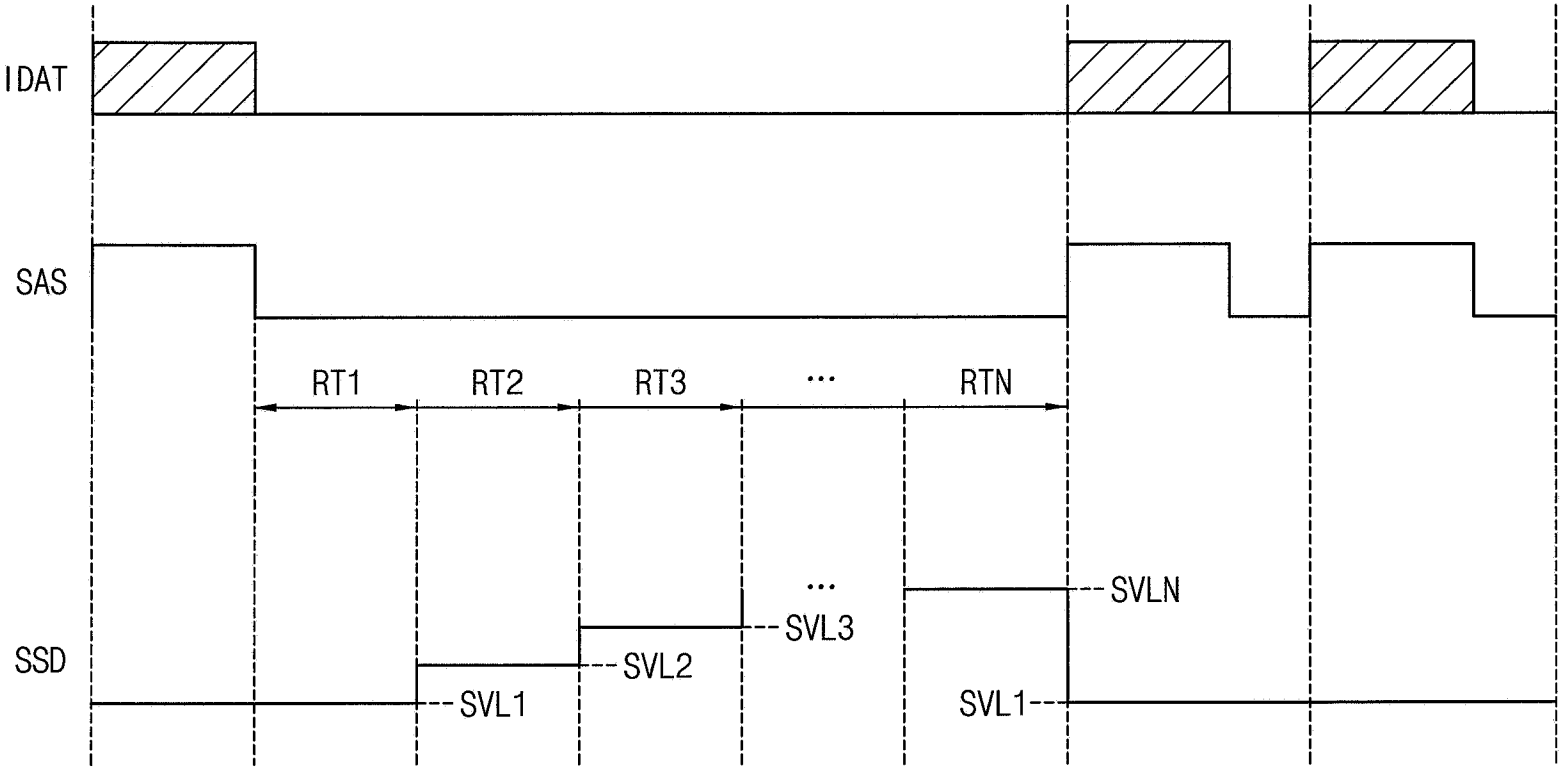
FIG. 12 is a timing diagram for describing an example of an operation of a shutter driver included in a display device of FIG. 10.

FIG. 10 is a block diagram illustrating a display device according to example embodiments, FIG. 11 is a timing diagram for describing an example of a display device of FIG. 10 in a variable frame mode, and FIG. 12 is a timing diagram for describing an example of an operation of a shutter driver included in a display device of FIG. 10.

Referring to FIG. 10, a display device 200 may include a display panel 211 including a plurality of pixels PX, a backlight unit (e.g., a backlight) 221 that generates light, a shutter panel 231 that transmits the light generated by the backlight unit 221 in response to a shutter driving signal SSD, a panel driver 240 that drives the display panel 211 by providing a panel driving signal SPD (e.g., including data signals and gate signals) to the display panel 211, a backlight controller 250 that drives the backlight unit 221 by providing a backlight driving signal SBD to the backlight unit 221, a shutter driver 260 that drives the shutter panel 231 by providing the shutter driving signal SSD to the shutter panel 231, a blank counter 270 that counts a time of a variable blank period, and a timing controller 280 that controls an operation of the display device 200. Compared with a display device 100 of FIG. 1, the display device 200 of FIG. 10 may further include the shutter panel 231 and the shutter driver 260.

The shutter panel 231 may transmit the light generated by the backlight unit 221, and a transmittance of the shutter panel 231 may be controlled by the shutter driving signal SSD. In some example embodiments, the shutter panel 231 may be implemented as a liquid crystal panel, but the shutter panel 231 may not be limited to the liquid crystal panel. For example, the display device 200 may have a dual cell structure where both of the display panel 211 and the shutter panel 231 are implemented as the liquid crystal panels. In some example embodiments, as illustrated in FIG. 10, the shutter panel 231 may be disposed between the backlight unit 221 and the display panel 211. In other example embodiments, the shutter panel 231 may be disposed on the display panel 211. Further, in some example embodiments, a resolution of the shutter panel 231 may be lower than a resolution of the display panel 211. For example, the shutter panel 231 may be implemented with about 10*10 blocks, but the number of blocks included in the shutter panel 231 may not be limited to 10*10. The shutter driver 260 may allow the shutter panel 231 to selectively transmit the light generated by the backlight unit 221 by providing the shutter driving signal SSD to the shutter panel 231, and may control the transmittance of the shutter panel 231 based on the shutter driving signal SSD.

In the display device 200 according to example embodiments, the blank counter 270 may count the time of the variable blank period, and may provide a blank time signal SBT representing the counted time of the variable blank period to the shutter driver 260. Based on the blank time signal SBT, the shutter driver 260 may increase the shutter driving signal SSD provided to the shutter panel 231 as the counted time of the variable blank period increases. For example, the shutter driving signal SSD may be a voltage signal, and the shutter driver 260 may increase a voltage level of the shutter driving signal SSD as the counted time of the variable blank period increases.

For example, as illustrated in FIG. 11, as the time of the variable blank period increases in a variable frame mode, a transmittance TRA_DP of the display panel 211 may be decreased due to a leakage current, etc. However, the shutter driver 260 may gradually increase the voltage level of the shutter driving signal SSD as the counted time of the variable blank period increases, and thus a transmittance TRA_SP of the shutter panel 231 may be gradually increased. For example, the shutter driver 260 may determine the voltage level of the shutter driving signal SSD such that a product of the transmittance TRA_DP of the display panel 211 that is decreased as the counted time of the variable blank period increases and the transmittance TRA_SP of the shutter panel 231 is maintained as a constant (e.g., at a constant value). Accordingly, although the transmittance TRA_DP of the display panel 211 is decreased as the counted time of the variable blank period increases, the display device 200 according to example embodiments may display an image with substantially constant luminance LUM_DP.

In some example embodiments, the shutter driver 260 may increase the voltage level of the shutter driving signal SSD step-by-step (e.g., in a stepwise fashion) each time the counted time of the variable blank period reaches one of a plurality of reference times. For example, as illustrated in FIG. 12, each time the counted time of the variable blank period reaches first through (N−1)-th reference times RT1, RT2, RT3, . . . , RTN−1, the shutter driver 260 may step-by-step increase the transmittance TRA_SP of the shutter panel 231 by increasing the voltage level of the shutter driving signal SSD step-by-step from a first voltage level SVL1 to second through N-th voltage levels SVL2, SVL3, . . . , SVLN. Accordingly, the display device 200 according to example embodiments may reduce or prevent deterioration of luminance and occurrence of a flicker caused by an increase in time of the variable blank period in the variable frame mode, thereby improving an image quality.

Figure 13:
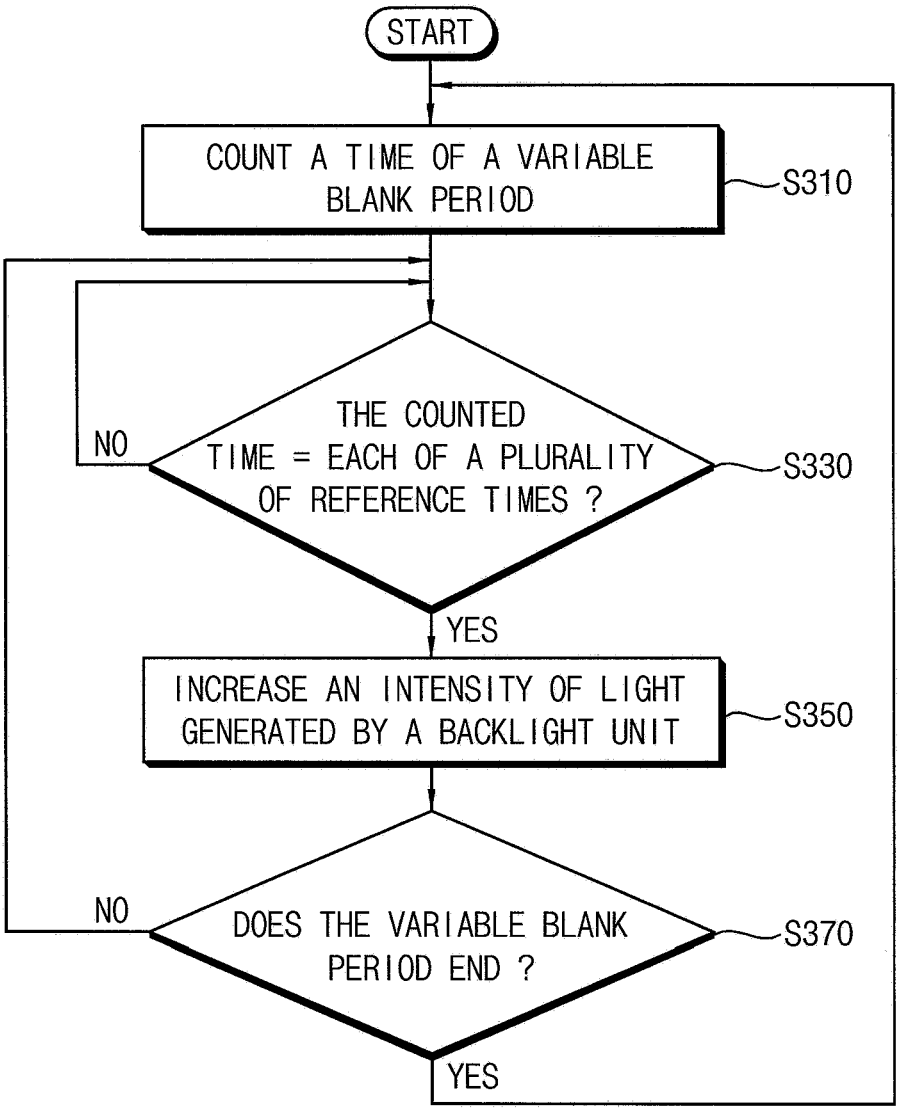
FIG. 13 is a flowchart illustrating a method of operating a display device according to example embodiments.

FIG. 13 is a flowchart illustrating a method of operating a display device according to example embodiments.

Referring to FIG. 1 and FIG. 13, in a method of operating a display device supporting a variable frame mode where each frame includes a variable blank period, a blank counter 160 may count a time of the variable blank period (S310).

The counted time of the variable blank period may be compared with a plurality of reference times (S330). According to example embodiments, comparing the counted time of the variable blank period with the plurality of reference times may be performed by a timing controller 170 or a backlight controller 180. Each time the counted time of the variable blank period reaches one of the plurality of reference times (S330: YES), the backlight controller 180 may increase an intensity of light generated by a backlight unit 120 step-by-step (e.g., in a stepwise fashion) (S350). In some example embodiments, to increase the intensity of the light generated by the backlight unit 120 step-by-step, the backlight controller 180 may increase a duty ratio of a backlight driving signal SBD provided to the backlight unit 120 step-by-step (e.g., in a stepwise fashion). In other example embodiments, to increase the intensity of the light generated by the backlight unit 120 step-by-step, the backlight controller 180 may increase a current level of the backlight driving signal SBD provided to the backlight unit 120 step-by-step (e.g., in a stepwise fashion).

Counting the time of the variable blank period (S310), comparing the counted time of the variable blank period with the plurality of reference times (S330), and increasing the intensity of the light (S350) may be repeated until the variable blank period ends (S370).

Figure 14:
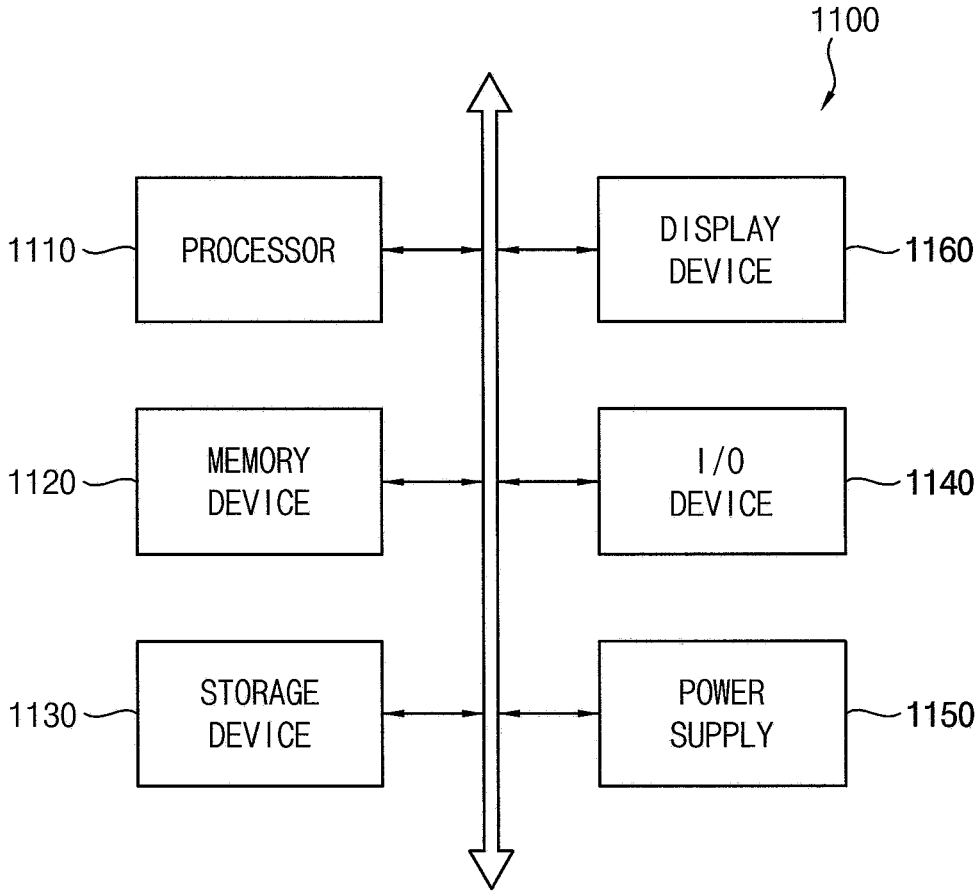
FIG. 14 is a block diagram illustrating an electronic device including a display device according to example embodiments.

FIG. 14 is a block diagram illustrating an electronic device including a display device according to example embodiments.

Referring to FIG. 14, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some example embodiments, the processor 1110 may be further coupled to an extended bus, such as a peripheral component interconnection (PCI) bus.

The memory device 1120 may store data for operations of the electronic device 1100. For example, the memory device 1120 may include at least one non-volatile memory device (such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc.,) and/or at least one volatile memory device (such as a dynamic random access memory (DRAM) device, a static random access memory (SRAM) device, a mobile dynamic random access memory (mobile DRAM) device, etc.).

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be coupled to other components through the buses or other communication links.

In some example embodiments, the display device 1160 may count a time of a variable blank period in a variable frame mode, and may increase an intensity of light generated by a backlight unit as the counted time of the variable blank period increases. In other example embodiments, the display device 1160 may count the time of the variable blank period in the variable frame mode, and may increase a shutter driving signal provided to a shutter panel as the counted time of the variable blank period increases. Accordingly, deterioration of luminance and occurrence of a flicker caused by an increase in time of the variable blank period in the variable frame mode may be reduced or prevented, and thus an image quality of the display device 1160 may be improved.

The inventive concepts may be applied to any display device supporting the variable frame mode, and any electronic device including the display device. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The use of "may" when describing embodiments of the present invention refers to "one or more embodiments of the present invention." Also, the term "exemplary" is intended to refer to an example or illustration.

The display device and/or any other relevant devices or components according to embodiments of the present invention described herein may be implemented utilizing any suitable hardware, firmware (e.g. an application-specific integrated circuit), software, or a combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on one substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and enhancements of the present inventive concept. Accordingly, all such modifications are intended to be included within the scope of the present inventive concept as defined in the claims, and equivalents thereof. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. A display device configured to support a variable frame mode, each frame of the variable frame mode comprising a variable blank period, the display device comprising:

a display panel comprising a plurality of pixels;

a backlight unit configured to generate light;

a panel driver configured to drive the display panel;

a backlight controller configured to drive the backlight unit; and a blank counter configured to count a time of the variable blank period to provide a counted time of the variable blank period, wherein the backlight controller is configured to control the backlight unit to increase an intensity of the light generated by the backlight unit as the counted time of the variable blank period increases.

2. The display device of claim 1, wherein the backlight controller is configured to increase a duty ratio of a backlight driving signal provided to the backlight unit as the counted time of the variable blank period increases such that a transmittance of the display panel that is decreased as the counted time of the variable blank period increases is compensated.

3. The display device of claim 1, wherein the backlight controller is configured to increase a duty ratio of a backlight driving signal provided to the backlight unit stepwise each time the counted time of the variable blank period reaches one of a plurality of reference times.

4. The display device of claim 3, wherein the backlight controller comprises:

a control unit configured to generate a duty ratio control signal representing the duty ratio that is increased stepwise each time the counted time of the variable blank period reaches one of the plurality of reference times;

a control voltage generator configured to generate a control voltage; and a backlight driver configured to generate the backlight driving signal having the duty ratio indicated by the duty ratio control signal based on the control voltage and the duty ratio control signal.

5. The display device of claim 4, wherein the control unit is configured to receive an adaptive synchronization signal representing a start or an end of the variable blank period, and initialize the duty ratio indicated by the duty ratio control signal when the adaptive synchronization signal indicates the end of the variable blank period.

6. The display device of claim 1, wherein the backlight controller is configured to increase a current level of a backlight driving signal provided to the backlight unit as the counted time of the variable blank period increases such that a transmittance of the display panel that is decreased as the counted time of the variable blank period increases is compensated.

7. The display device of claim 1, wherein the backlight controller is configured to increase a current level of a backlight driving signal provided to the backlight unit stepwise each time the counted time of the variable blank period reaches one of a plurality of reference times.

8. The display device of claim 7, wherein the backlight controller comprises:

a control unit configured to generate a control voltage control signal representing a voltage level that is increased stepwise each time the counted time of the variable blank period reaches one of the plurality of reference times;

a control voltage generator configured to generate a control voltage having the voltage level indicated by the control voltage control signal; and a backlight driver configured to generate the backlight driving signal having the current level corresponding to the voltage level of the control voltage based on the control voltage.

9. The display device of claim 8, wherein the control unit is configured to receive an adaptive synchronization signal representing a start or an end of the variable blank period, and initialize the voltage level indicated by the control voltage control signal when the adaptive synchronization signal indicates the end of the variable blank period.

10. The display device of claim 1, wherein the backlight controller is configured to increase a duty ratio or a current level of a backlight driving signal provided to the backlight unit as the counted time of the variable blank period increases such that a transmittance of the display panel that is decreased as the counted time of the variable blank period increases is compensated.

11. The display device of claim 1, wherein, each time the counted time of the variable blank period reaches one of a plurality of reference times, the backlight controller is configured to increase a duty ratio of a backlight driving signal provided to the backlight unit stepwise until the duty ratio of the backlight driving signal reaches a maximum duty ratio, and increase a current level of the backlight driving signal stepwise after the duty ratio of the backlight driving signal reaches the maximum duty ratio.

12. The display device of claim 11, wherein the backlight controller comprises:

a control unit configured to generate a duty ratio control signal representing the duty ratio that is increased stepwise each time the counted time of the variable blank period reaches one of the plurality of reference times until the duty ratio of the backlight driving signal reaches the maximum duty ratio, and to generate a control voltage control signal representing a voltage level that is increased stepwise each time the counted time of the variable blank period reaches one of the plurality of reference times after the duty ratio of the backlight driving signal reaches the maximum duty ratio;

a control voltage generator configured to generate a control voltage having the voltage level indicated by the control voltage control signal; and a backlight driver configured to generate the backlight driving signal having the current level corresponding to the voltage level of the control voltage and having the duty ratio indicated by the duty ratio control signal based on the control voltage and the duty ratio control signal.

13. The display device of claim 12, wherein the control unit is configured to receive an adaptive synchronization signal representing a start or an end of the variable blank period, and initialize the duty ratio indicated by the duty ratio control signal and the voltage level indicated by the control voltage control signal when the adaptive synchronization signal indicates the end of the variable blank period.

14. A display device configured to support a variable frame mode, each frame of the variable frame mode comprising a variable blank period, the display device comprising:

a display panel comprising a plurality of pixels;

a backlight unit configured to generate light;

a shutter panel configured to transmit the light generated by the backlight unit in response to a shutter driving signal;

a panel driver configured to drive the display panel;

a backlight controller configured to drive the backlight unit;

a shutter driver configured to drive the shutter panel by providing the shutter driving signal to the shutter panel; and a blank counter configured to count a time of the variable blank period to provide a counted time of the variable blank period, wherein the shutter driver is configured to increase the shutter driving signal provided to the shutter panel as the counted time of the variable blank period increases.

15. The display device of claim 14, wherein the shutter driver is configured to increase a voltage level of the shutter driving signal to increase a transmittance of the shutter panel as the counted time of the variable blank period increases.

16. The display device of claim 15, wherein the shutter driver is configured to determine the voltage level of the shutter driving signal such that a product of a transmittance of the display panel and the transmittance of the shutter panel is maintained as a constant.

17. The display device of claim 14, wherein the shutter driver is configured to increase a voltage level of the shutter driving signal stepwise each time the counted time of the variable blank period reaches one of a plurality of reference times.

18. A method of operating a display device supporting a variable frame mode, each frame of the variable frame mode comprising a variable blank period, the method comprising:

counting a time of the variable blank period to provide a counted time of the variable blank period;

comparing the counted time of the variable blank period with a plurality of reference times; and increasing an intensity of light generated by a backlight unit stepwise each time the counted time of the variable blank period reaches one of the plurality of reference times.

19. The method of claim 18, wherein the increasing the intensity of the light generated by the backlight unit stepwise comprises increasing a duty ratio of a backlight driving signal provided to the backlight unit stepwise.

20. The method of claim 18, wherein the increasing the intensity of the light generated by the backlight unit stepwise comprises increasing a current level of a backlight driving signal provided to the backlight unit stepwise.

* * * * *